US012565782B2

(12) United States Patent
Bolger

(10) Patent No.: US 12,565,782 B2
(45) Date of Patent: Mar. 3, 2026

(54) METHODS AND FORMULATIONS FOR SEALING STRUCTURAL LEAKS

(71) Applicant: GDWS PTY LTD, Botany (AU)

(72) Inventor: Robin Bolger, Helensvale (AU)

(73) Assignee: GDWS Pty. Ltd., Botany (AU)

( * ) Notice: Subject to any disclaimer, the term of this patent is extended or adjusted under 35 U.S.C. 154(b) by 531 days.

(21) Appl. No.: 18/014,211

(22) PCT Filed: Mar. 4, 2021

(86) PCT No.: PCT/AU2021/050185
§ 371 (c)(1),
(2) Date: Jan. 3, 2023

(87) PCT Pub. No.: WO2021/174303
PCT Pub. Date: Sep. 10, 2021

(65) Prior Publication Data

US 2023/0340795 A1 Oct. 26, 2023

(30) Foreign Application Priority Data

Mar. 5, 2020 (AU) ..... 2020900684

(51) Int. Cl.
*E04G 23/02* (2006.01)

(52) U.S. Cl.
CPC ..... *E04G 23/0211* (2013.01)

(58) Field of Classification Search
CPC ... E04G 23/0211; E04G 23/0203; E02D 3/12; C09D 5/34; E04F 21/165; E21B 33/138; E21D 11/38
See application file for complete search history.

(56) References Cited

U.S. PATENT DOCUMENTS 3,015,642 A * 1/1962 Bawn ..... C08C 1/07 524/808
4,211,050 A * 7/1980 Cvacho ..... E02D 31/02 239/271
4,296,932 A * 10/1981 Grobler ..... F16L 55/164 277/316
4,360,994 A 11/1982 Hodges
4,607,469 A * 8/1986 Harrison ..... F16L 5/02 52/220.8

(Continued)

FOREIGN PATENT DOCUMENTS

CN 107724704 A 2/2018
GB 2188937 A 10/1987

(Continued)

*Primary Examiner* — Brian E Glessner
*Assistant Examiner* — Daniel J Kenny
(74) *Attorney, Agent, or Firm* — Edwin D. Schindler

(57) ABSTRACT

A method of sealing a leaking crack in a structure involves drilling a delivery channel into the structure adjacent the crack and in towards the crack to join the crack. A delivery nozzle is inserted into the delivery channel to inject a sealant comprising latex and water under pressure into the crack. The sealant may be injected until the sealant forms a seepage on an exterior surface of the crack which is sprayed with a reactive agent to cure the sealant to form a skin. Thereafter further sealant may be injected via the delivery channel after the skin is formed to enhance the ingress of sealant within the crack.

17 Claims, 3 Drawing Sheets

(56) References Cited

U.S. PATENT DOCUMENTS

| | | | | |
|---|---|---|---|---|
| 8,535,432 | B2 * | 9/2013 | Yoneda | C09B 47/064<br>540/125 |
| 9,528,286 | B2 * | 12/2016 | Wheatley | E04G 23/0214 |
| 10,730,069 | B2 * | 8/2020 | Lussier | B05C 17/00506 |
| 10,947,436 | B2 * | 3/2021 | van Dyk | E02D 3/12 |
| 2018/0209113 | A1 * | 7/2018 | Birtele | E02D 35/005 |
| 2020/0087884 | A1 * | 3/2020 | Rigby | E02D 29/12 |

FOREIGN PATENT DOCUMENTS

| | | | |
|---|---|---|---|
| JP | 2004-4251010 | A | 9/2004 |
| WO | WO 2019/169423 | A1 | 9/2019 |

* cited by examiner

METHODS AND FORMULATIONS FOR SEALING STRUCTURAL LEAKS

FIELD OF THE INVENTION

This invention relates generally to methods and formulations for sealing structural leaks.

BACKGROUND OF THE INVENTION

Structural water leaks are conventionally plugged with an injection of polyurethane foam. However, polyurethane has poor durability, degrades in saltwater and is difficult to apply.

Latex based sealing compositions have been proposed including by WO 2019/169423 A1 (RELBORGN PTY LTD AND TRIOMVIRI PTY LTD) 12 Sep. 2019 which described various mining to civil engineering sealing applications for the repair of tunnels or the formation of containment barriers about spills or structures which may include waste storage facilities.

The present invention seeks to provide a way to overcome or substantially ameliorate at least some of the deficiencies of the prior art, or to at least provide an alternative.

It is to be understood that, if any prior art information is referred to herein, such reference does not constitute an admission that the information forms part of the common general knowledge in the art, in Australia or any other country.

SUMMARY OF THE DISCLOSURE

There is provided herein a method of sealing a leaking crack in a structure using a latex-based sealant which is subsequently cured by a reactive agent, thereby providing a durable seal including one resistant to saltwater. A method of sealing a structural leak according to the invention is outlined by claim 1. Further features are outlined by dependent claims.

The method comprises drilling the delivery channel into the structure adjacent the crack and in towards the crack until the delivery channel joins the crack.

Thereafter, a delivery nozzle of an injection packer or the like is inserted into the delivery channel and sealant comprising latex and water is injected under pressure via the delivery nozzle into the crack.

The sealant is injected until the sealant forms a seepage on an exterior surface of the crack. Thereafter, the seepage is sprayed with the reactive agent using a spray gun of a like to cure the sealant across the surface of the crack to form a skin across the exterior surface of the crack.

Thereafter, further sealant is injected via the delivery channel after the skin has formed. The further sealant may be injected at a higher pressure, such as in excess of 500 psi.

The skin forms an external barrier which retains the further injected sealant within the crack under increased pressure thereby enhancing the ingress of sealant within the entirety of the crack.

Reactive agent may be further injected via the delivery nozzle to cure the sealant within the crack. Furthermore, further delivery channels may be drilled along the length of the crack for further application of sealant.

The sealant may initially comprise a pH of approximately 10 or above and the reactive agent is applied to bring the pH down preferably to approximately 7-7.5 which our trial and experimentation found provides for optimal resultant sealant properties.

The formulation of reactive agent may be selected according to the pH of water seeping from the crack. For a pH of less than 7, typical of groundwater leaks, typically being freshwater, a first formulation of reactive agent may comprise sodium chloride and the sodium chloride may be varied according to the pH range of the water. Conversely, a pH of greater than seven, typical of saltwater leaks, a second formulation of reactive agent may comprise calcium chloride which may similarly be varied depending on the measured pH of the leaking water.

An injection packer may be used to inject the sealant which comprises interchangeable sleeves of different diameter to match that of the delivery channel. The injection packer has been designed so there is no need to drain the pump and delivery hose during application, thereby stopping product wastage and maximising time spent on the task.

As such, with the foregoing in mind, in accordance with an embodiment, there is provided a method of sealing a leaking crack in a structure, the method comprising: drilling a delivery channel into the structure adjacent the crack and in towards the crack to join the crack, inserting a delivery nozzle into the delivery channel and injecting a sealant via the delivery nozzle comprising latex and water under pressure into the crack, injecting the sealant until the sealant forms a seepage on an exterior surface of the crack, spraying the seepage with a reactive agent to cure the sealant across the surface of the crack to form a skin across the exterior surface of the crack; and injecting further sealant via the delivery channel after the skin is formed.

Injecting further sealant may further comprise increasing the pressure of the sealant after the skin may be formed.

The pressure may be increased to greater than 500 psi.

The pressure may be increased to less than 2500 psi.

The method may further comprise injecting reactive agent via the delivery channel to cure the sealant within the crack.

The reactive agent may be injected after the skin may have formed.

The method may further comprise drilling further delivery channels along a length of the crack and injecting further sealant via the further delivery channels.

The method may comprise using an injection packer comprising a delivery conduit, a smaller diameter sleeve slidable over the delivery conduit and a larger diameter sleeve slidable over the smaller diameter sleeve and wherein the method may comprise either retaining or removing the larger diameter sleeve depending on the diameter of the delivery channel.

The injection packer may further comprise a smaller diameter distal collar and a larger diameter distal collar attachable to a distal end of the delivery conduit and wherein the method may comprise attaching the larger diameter distal collar with the larger diameter sleeve.

The method may comprise using an injection packer comprising a proximal annulus, an inner conduit and a distal collar attachable to a distal end of the inner conduit, the proximal annulus and the distal collar respectively bearing against either end of an exterior sleeve and wherein the method may comprise tightening the proximal annulus to bear the exterior sleeve against the distal collar to cause the distal collar to expand within the delivery conduit.

The sealant may comprise a latex to water ratio of approximately 3:2.

The method may further comprise a base to maintain the pH of the sealant to above 7.5 prior application.

The base may maintain the pH of the sealant at a pH above 10.

The base may comprise a weak base.

The base may comprise ammonia.

1 L of sealant may comprise approximately 600 mL latex, approximately 398 mL of water and approximately 2 mL of ammonia.

The water may have neutral pH.

The reactive agent may be formulated to lower the pH of the sealant to between 7 and 8.

The reactive agent may be formulated to lower the pH of the sealant to approximately 7-7.5.

The method may comprise selecting a formulation of reactive agent according to the pH of the reactive agent and the pH of water leaking from the crack.

The method may comprise a litmus test of the water leaking from the crack prior application.

For a pH of less than 7 of the water leaking from the crack, a first formulation of reactive agent may be selected comprising water and sodium chloride.

The first formulation of reactive agent may comprise, for a 1 L make up thereof, approximately 995 mL of water, approximately 3 mm of calcium chloride and approximately 2 mL of sodium chloride.

The amount of sodium chloride may be varied according to the pH of the water leaking from the crack.

For a 1 L make up of the first formulation of reactive agent, the sodium chloride may be varied between 2-0 mL for a pH range of between 6-6.8.

For a pH of greater than 7 of the water leaking from the crack, a second formulation of reactive agent may be selected comprising water and calcium chloride.

The second formulation of reactive agent may comprise, for a 1 L make up thereof, approximately 995 mL of water and approximately 5 mL of calcium chloride.

The amount of calcium chloride may be varied according to the pH of the water leaking from the crack.

For a 1 L make up of the second formulation of reactive agent, the calcium chloride may be varied between 0-6 mL for a pH range of between 7.0-8.8.

The first formulation of reactive agent may be used for freshwater leaks.

The second formulation of reactive agent may be used for saltwater leaks.

The delivery nozzle may comprise a diameter ranging from 10 mm-50 mm.

The delivery channel may commence between 50-75 mm from the crack.

The delivery channel may comprise a diameter of between 10 mm-50 mm.

The delivery channel may extend in at an angle of approximately 45°.

The delivery channel may extend in to a depth of 100-200 mm.

According to a further aspect, there is provided a two-part formulation for sealing a structural leak, the formulation comprising sealant comprising latex and water and a base to raise the pH of the sealant to above approximately 10 and a selection of a reactive agent formulation to lower the pH of the sealant to a pH of approximately 7-7.5 when applied to the sealant and wherein the selection of the reactive agent may be selected from first and second reactive agent formulations depending on the pH of water seeping from the crack.

The first formulation may comprise water and sodium chloride.

The sodium chloride may be varied between 2-0 mL for a pH range of the water seeping from the crack of between 6-6.8.

The second formulation may comprise water and calcium chloride.

The calcium chloride may be varied between 0-6 mL for a pH range of the water seeping from the crack of between 7-8.8.

Other aspects of the invention are also disclosed.

BRIEF DESCRIPTION OF THE DRAWINGS

Notwithstanding any other forms which may fall within the scope of the present invention, preferred embodiments of the disclosure will now be described, by way of example only, with reference to the accompanying drawings in which.

DESCRIPTION OF EMBODIMENTS

Figure 1:
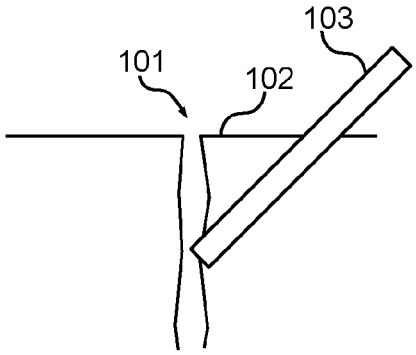
FIGS. 1-6 illustrates sealing a leaking crack in a structure in accordance with an embodiment.
Figure 2:
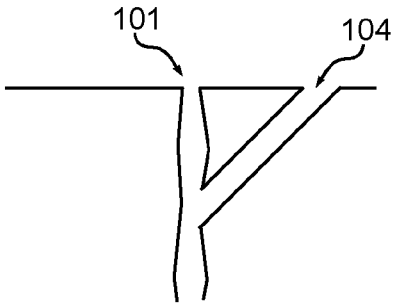
Figure 8:
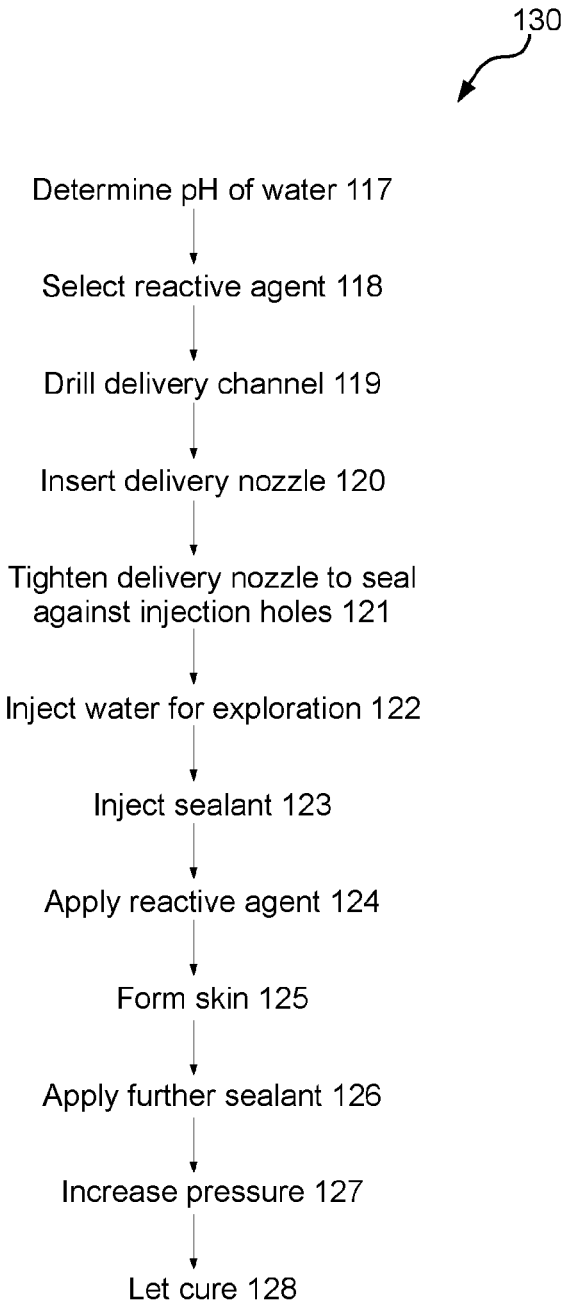
FIG. 8 shows steps of a method of sealing a leaking crack in a structure in accordance with an embodiment.

Referring to FIG. 8, a method 130 of sealing a leaking crack 101 in a structure 102 as shown in FIG. 1 may comprise determining the pH of the water leaking from the crack 101 at step 117 for the selection of an appropriate reactive agent 115 at step 118.

The method 130 comprises drilling a delivery channel 104 using a drill bit 130 adjacent and in towards a leaking crack 101 in a structure 102, typically of concrete, until the delivery channel 104 joins the crack 101.

Typically, the delivery channel 104 may commence between 50 to 75 mm from the crack 101, may comprise a diameter of between 10 mm-50 mm to suit an injection-packer 105 as shown in FIG. 7 and may extend in at an angle of approximately 45° to between depth of 100-200 mm. Further delivery channels 104 may be drilled along the length of the crack 101.

Figure 3:
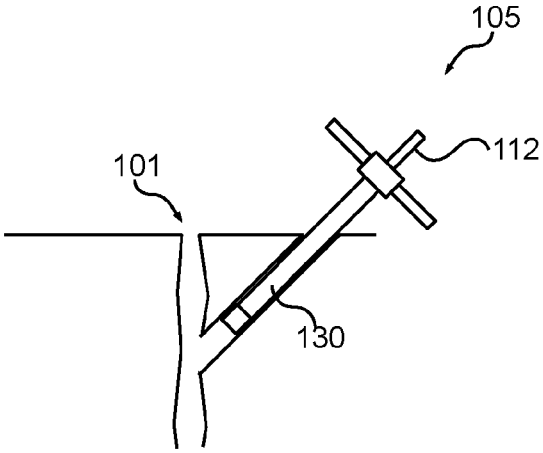

As shown in FIG. 3, at step 120, a delivery nozzle 131 of an injection-packer 105 is inserted into the delivery channel 104. The delivery nozzle 131 may comprise a diameter selected for a desirous flowrate of sealant and may comprise an exterior diameter ranging from 10 mm-50 mm.

Figure 7A:
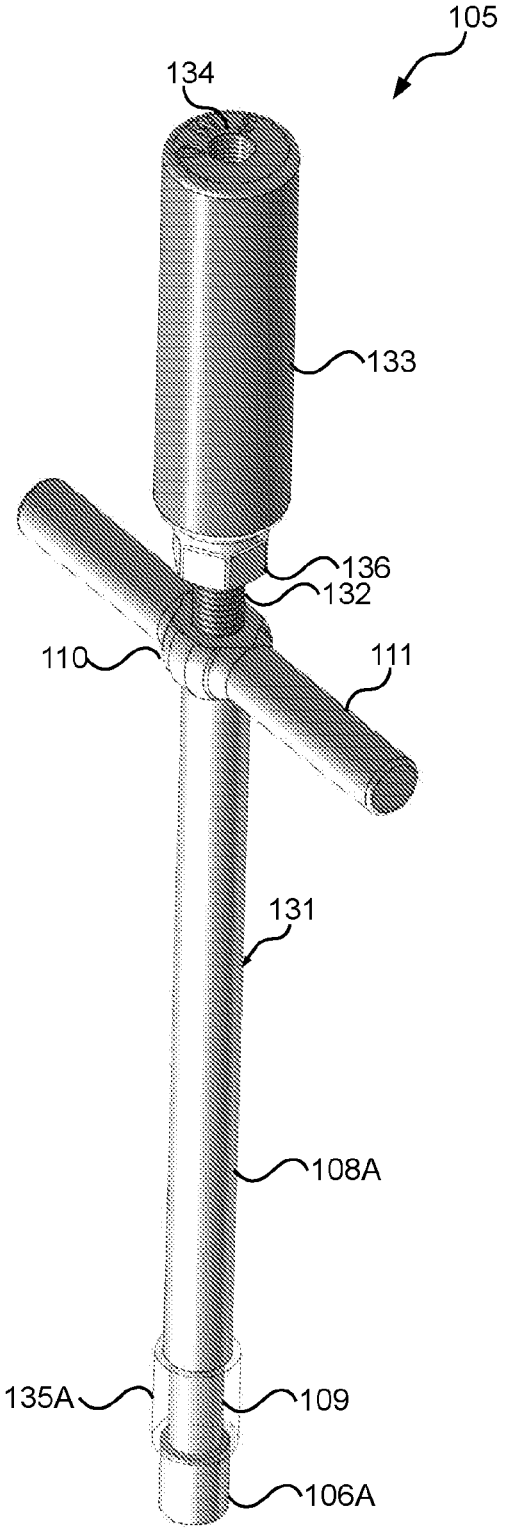
FIGS. 7A and 7B show two configured forms of an injection-packer in accordance with an embodiment.
Figure 7B:
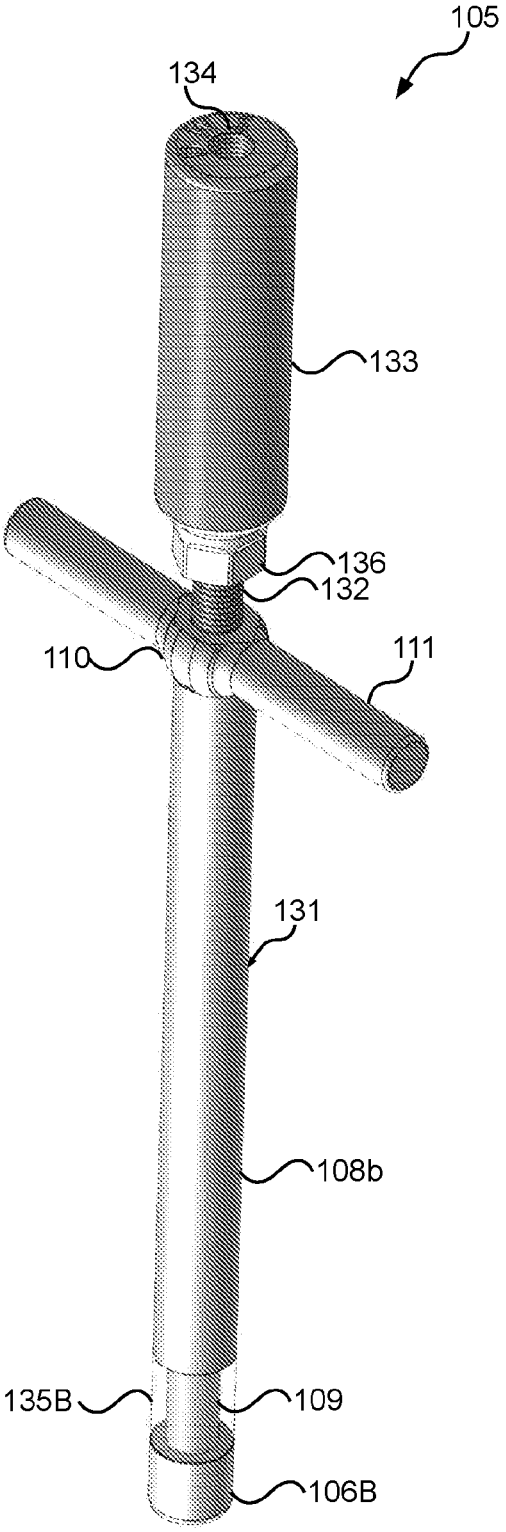

FIGS. 7A and 7B illustrate a packer 105 in accordance with an embodiment and, more particularly, to the way in which the packer 105 can be reconfigured to suit delivery channels 104 of differing diameters.

Specifically, the delivery nozzle 131 may comprise an inner conduit 109 through which sealant is injected into the delivery channel 104 and interchangeable external sleeves 108.

The packer 105 may further comprise distal retention collars 106, each conforming to an external diameter of a corresponding sleeve 108. Each retention collar 106 may comprise interior threading which engages exterior threading on a distal end of the internal conduit 109. The retention collar 106 may be screwed onto unscrewed from the exterior threading of the internal delivery conduit by hand.

The delivery nozzle 131 may further comprise a distal expanding seal 135 such as a rubber. Whereas FIGS. 7A and 7B show the distal expanding seal 135 of the same size, in embodiments the packer 105 may similarly comprise expanding seals 135 conforming in external diameter with a corresponding sleeve 108 and retention collar 106.

The expanding seal 135 is compressed between the retention collar 106 and the sleeve 108 which causes the retention collar 106 to expand to seal against interior surfaces of the delivery channel 104.

FIG. 7 shows an external sleeve 108A and corresponding retention collar 106A having a smaller diameter than that of a relatively larger sleeve 108B and retention collar 106B shown in FIG. 7B.

For example, the external sleeve 108A and retention collar 106A may comprise an exterior diameter of 14 mm suited for 14 mm delivery channels 104 whereas external sleeve 108B and retention collar 106B may comprise an exterior diameter of 18 mm suited for 18 mm delivery channels. The respective expanding seals 135 may similarly have corresponding diameters.

A proximal annulus 110 having turning handles 111 may bear against a proximal end of the external sleeve 108 to urge the external sleeve 108 along the inner conduit 109 towards a distal end thereof to compress the expanding seal 135 against the retention collar 106. The annulus 110 may comprise interior threading engaging exterior threading 132 on a proximal end of the inner conduit 109.

The packer 105 may have a main cylindrical handle 133 connected to the inner conduit 109.

The main cylindrical handle 133 may comprise a bore 134 therethrough fluidly connecting the inner conduit 109. The inner bore 134 may comprise interior threading for a suitable coupling for connection of the delivery hose thereto.

As such, in use, the main cylindrical handle 133 may be held with one hand whilst turning the turning handles 111.

Figure 4:
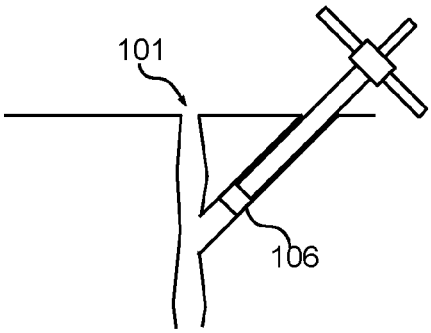

For example, as shown in FIG. 4, at step 121, for injecting sealant, the delivery hose may be coupled to the bore 134 of the main handle 133 and the distal end of the delivery nozzle 131 inserted into the delivery channel 104.

Once at the requisite insertion depth, the main handle 133 may be held firm whilst the turning handles 111 are rotated clockwise to urge the external sleeve 108 towards the distal retention collar 106 to cause the expanded seal 135 to expand against inner surfaces of the delivery conduit 104 to thereby form a tight seal to allow sealant to be injected under pressure into the crack 101.

A hex nut 136 or similar may be used to gain purchase of the handle 133 using a spanner if required.

Removing the delivery nozzle 131 may take the reverse procedure wherein the turning handles 111 are rotated counter clockwise to relax the expanding seal 135 to allow the delivery nozzle 131 to be removed.

Assuming the 14 mm diameter external sleeve 108A, expanding seal 135A and retention collar 106A are engaged, reconfiguration of the packer 105 for an 18 mm diameter delivery channel 104 may comprise unscrewing the retention collar 106 by hand and then sliding the expanding seal 135A and external sleeve 108A from the inner conduit 109. The external sleeve 108A and expanding seal 135A may have an internal diameter to clear the distal threading of the inner conduit 109 for engaging the retention collar 106A.

Thereafter, the 18 mm diameter external sleeve 108B may be slid over the internal conduit 109, followed by the 18 mm diameter expanding seal 135B further followed by the 18 mm diameter retention collar 106B which is screwed onto the threading of the distal end of the internal conduit 109.

At step 122, water may be injected via the injection-packer 105 to explore the extent of the crack 101.

Figure 5:
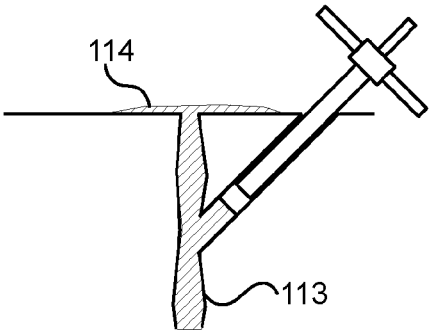

As shown in FIG. 5, at step 123, sealant 113 is injected into the crack 101.

A sealant pump may supply sealant 113 via the hose connector 112 from a sealant reservoir. A compressor may supply a volume and pressure of air required to pressurise the sealant reservoir to pump the sealant 113 therefrom via the hose connector 112. The compressor may be adjustable to vary the flow rate and pressure of the supply of sealant 113.

The sealant 113 comprises latex and water, preferably at a ratio of approximately 3:2. The sealant 113 may comprise a base to maintain the pH of the sealant 113 above 7.5, (preferably at about a pH of 10-10.5) prior application to allow for the prolonged storage thereof. The base may comprise a weak base such as ammonia.

As the sealant 113 thickens under shear, caution must be taken not to inject the sealant 113 at too high a pressure. Care must also be taken to avoid aeration.

In one embodiment, 1 L of sealant 113 comprises approximately 600 mL of latex, approximately 398 mL of water and approximately 2 mL of ammonia. The water for the sealant 113 may be tested prior mixing to ensure that the water has a neutral pH.

At step 124, the reactive agent 115 is applied which cures the sealant 113. The reactive agent 115 is applied to reduce the pH of the sealant 113 from a pH of approximately 10-10.5 to approximately 7-7.5 which trial and experimentation shows is an optimal pH for the resultant sealing properties of the sealant 113.

The formulation of reactive agent 115 may be selected depending on the pH of the reactive agent 115 and the pH of water seeping from the crack 101 to achieve the optimal resultant pH of the sealant of approximately 7-7.5.

For example, for water having a pH of less than 7-7.5, a first formulation of reactive agent 115 may be selected comprising, for 1 L make up thereof, approximately 995 mL of water, approximately 3 mL of calcium chloride and approximately 2 mL of sodium chloride.

The amount of sodium chloride may be varied depending on the pH of the water according to the following table:

| pH of Water | Millilitres of added sodium chloride |
|---|---|
| 6.0 | 2 |
| 6.2 | 1 |
| 6.4 | 1 |
| 6.6 | 1 |
| >6.6 | 0 |

For water having a pH of greater than 7, a second formulation of reactive agent 115 may be selected comprising, for 1 L make up thereof, approximately 995 mL of water and approximately 5 mL of calcium chloride.

The amount of calcium chloride may be varied depending on the pH of the water according to the following table:

| pH of Water | Millilitres of added calcium chloride |
|---|---|
| <7.4 | 0.00 |
| 7.6 | 2.00 |
| 7.8 | 2.00 |
| 8.0 | 4.00 |
| 8.2 | 4.00 |
| 8.4 | 4.00 |
| >8.6 | 6.00 |

The first formulation of reactive agent 112 may be selected for fresh or groundwater application which typically has a pH ranging from 6-8.5. The second formulation of reactive agent 115 may be used for saltwater which typically has a pH ranging from approximately 7.6-8.4.

As shown in FIG. 5, the sealant 113 may be injected until the sealant 113 forms a seepage 114 on an exterior surface of the crack 101.

Figure 6:
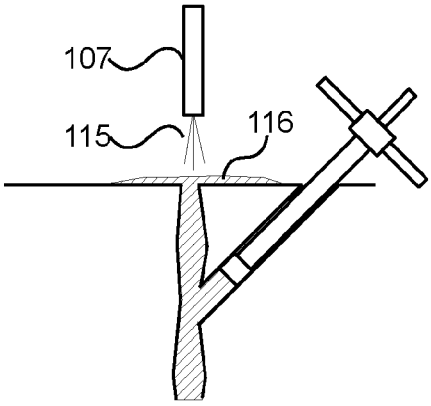

As shown in FIG. 6, the reactive agent 115 may be sprayed onto the seepage 114 using a spray gun 107 which cures the exposed sealant 113 to form a skin 116 at step 125.

Once the skin 116 is formed and thereby seals the entrance of the crack 101, further sealant 113 may be injected via the injection-packer 105 which, by being blocked by the barrier formed by the exterior skin 116 is forced deeper into the crack 101. At this time, the sealant 113 may be injected under higher pressure which may range between 500-2500 psi at step 127.

Optionally, reactive agent may be injected through the delivery channel 104 to cure the sealant 113 from behind.

Sealant 113 may be injected in a similar manner via other delivery channels 104 to seal the crack 101.

Once sufficient quantity of sealant 113 has been injected, the sealant 113 may be allowed to cure into a hardened yet flexible seal at step 128, thereby effectively sealing the crack 101.

The foregoing description, for purposes of explanation, used specific nomenclature to provide a thorough understanding of the invention. However, it will be apparent to one skilled in the art that specific details are not required in order to practise the invention. Thus, the foregoing descriptions of specific embodiments of the invention are presented for purposes of illustration and description. They are not intended to be exhaustive or to limit the invention to the precise forms disclosed as obviously many modifications and variations are possible in view of the above teachings. The embodiments were chosen and described in order to best explain the principles of the invention and its practical applications, thereby enabling others skilled in the art to best utilize the invention and various embodiments with various modifications as are suited to the particular use contemplated. It is intended that the following claims and their equivalents define the scope of the invention.

The term "approximately" or similar as used herein should be construed as being within 10% of the value stated unless otherwise indicated.

The invention claimed is:

1. A method of sealing a leaking crack in a structure, comprising the steps of:

drilling a delivery channel into the structure adjacent the crack and in towards the crack to join the crack;

inserting a delivery nozzle into the delivery channel and injecting a sealant via the delivery nozzle, the sealant comprising latex and water under pressure into the crack;

injecting the sealant until the sealant forms a seepage on an exterior surface of the crack;

spraying the seepage with a reactive agent to cure the sealant across the surface of the crack to form a skin across the exterior surface of the crack which is continuous and synonymous with the sealant within the crack;

injecting further sealant via the delivery channel after the skin is formed; and allowing the sealant to cure into a flexible durable seal for the crack.

2. The method as claimed in claim 1, wherein injecting further sealant via the delivery channel after the skin is formed further comprises increasing the pressure of the sealant to a range between 500-2500 psi.

3. The method as claimed in claim 1, further comprising injecting further reactive agent via the delivery channel following injecting further sealant to allow the sealant to cure into a flexible durable seal within the crack.

4. The method as claimed in claim 1, further comprising the steps of drilling additional delivery channels along a length of the crack and injecting further sealant via the additional delivery channels.

5. The method as claimed in claim 1, further comprising the step of using an injection packer comprising the delivery nozzle, the injection packer having an inner conduit through which sealant is injected into the delivery channel and at least two interchangeable external sleeves retainable about the inner conduit, said interchangeable external sleeves having differing external diameters suited for respective delivery channel inner diameters.

6. The method as claimed in claim 5, wherein the injection packer further comprises at least one interchangeable distal retention collar retainable about the inner conduit and cooperating with a respective external sleeve of the same diameter to compress an expanding seal therebetween at a distal end of the delivery nozzle, causing the expanding seal to expand and seal the delivery channel.

7. The method as claimed in claim 6, wherein the inner conduit screwably engages an annulus having turning handles which, when turned in a first direction, urges an installed external sleeve towards a distal end to compress the expanding seal against an installed distal retention collar.

8. The method as claimed in claim 1, wherein the method further comprises the step of using an injection packer comprising a proximal annulus, an inner conduit and a distal collar attachable to a distal end of the inner conduit, the proximal annulus and the distal collar respectively bearing against either end of an exterior sleeve and wherein the method further comprises the step of tightening the proximal annulus to bear the exterior sleeve against the distal collar to cause the distal collar to expand within the delivery channel.

9. The method as claimed in claim 1, wherein the delivery channel extends in at an angle of approximately 45° to a depth of 100-200 mm.

10. The method as claimed in claim 1, wherein the sealant further comprises a weak base for maintaining the pH of the sealant to above 7.5, prior to application.

11. The method as claimed in claim 10, wherein the water for the sealant is tested prior to mixing to ensure it has a neutral pH.

12. The method as claimed in claim 11, wherein the reactive agent is formulated to lower the pH of the sealant to approximately 7-7.5.

13. The method as claimed in claim 12, wherein the method further comprises determining the pH of the water leaking from the crack and selecting a formulation of reactive agent according to the pH of the reactive agent and the pH of water leaking from the crack to achieve an optimal result pH for the sealant of approximately 7.0-7.5.

14. The method as claimed in claim 13, wherein if the water leaking from the crack has a pH of less 7-7.5, a first formulation of reactive agent is selected comprising sodium chloride wherein the amount of sodium chloride is varied according to the pH of the water leaking from the crack.

15. The method as claimed in claim 13, wherein if the water leaking from the crack has a pH of greater that 7, a second formulation of reactive agent is selected comprising calcium chloride wherein the amount of calcium chloride is varied according to the pH of the water leaking from the crack.

16. The method as claimed in claim 10, wherein weak base is ammonia.

17. The method as claimed in claim 10, wherein the pH of the sealant is between 10-10.5, prior to application.

* * * * *